United States Patent [19]

Pozzato et al.

[11] 4,018,395

[45] Apr. 19, 1977

[54] PLATE MILL FOR PEBBLES, GRAVEL OR LIKE MATERIALS

[76] Inventors: Tarcisio Pozzato; Mariano Pozzato; Alberto Pozzato, all of Via Grattacavallo 2, Sandrigo (Vicenza), Italy

[22] Filed: Feb. 25, 1976

[21] Appl. No.: 661,327

[30] Foreign Application Priority Data

Mar. 20, 1975 Italy ..... 21468/75

[52] U.S. Cl. ..... 241/252; 241/253; 241/259.2; 241/259.3

[51] Int. Cl.[2] ..... B02C 7/10; B02C 7/16

[58] Field of Search ..... 241/250–254, 241/257 R, 259, 259.1, 259.2, 259.3

[56] References Cited

UNITED STATES PATENTS

| | | | |
|---|---|---|---|
| 641,654 | 1/1900 | Sturtevant | 241/252 |
| 2,221,342 | 11/1940 | Butler | 241/257 R X |
| 2,884,036 | 4/1959 | Symons | 241/252 X |
| 2,947,485 | 8/1960 | Woodruff et al. | 241/259.2 X |
| 3,222,038 | 12/1965 | Ashcraft | 241/253 X |

*Primary Examiner*—Roy Lake
*Assistant Examiner*—Howard N. Goldberg
*Attorney, Agent, or Firm*—Weingarten, Maxham & Schurgin

[57] ABSTRACT

A plate mill for crushing gravel, pebbles or the like, of the type comprising two rotating discs or plates is provided with means for adjusting the separation of the plates while they are in motion so that the required adjustment in relation to the size of the output particles from the mill can be achieved readily. A first one of the plates is carried by a rotating cylinder, and is spaced from the cylinder by spacers; a second plate is carried between the end of the cylinder and the first plate at the end of a shaft mounted by means of a ball and socket coupling in a piston which is axially movable within the rotating cylinder. Oil passageways leading to the interior of the cylinder direct pressure fluid, preferably lubricating oil, to the underside of the piston so that the second plate can be urged thereby toward the first plate.

6 Claims, 2 Drawing Figures

Figure 1:
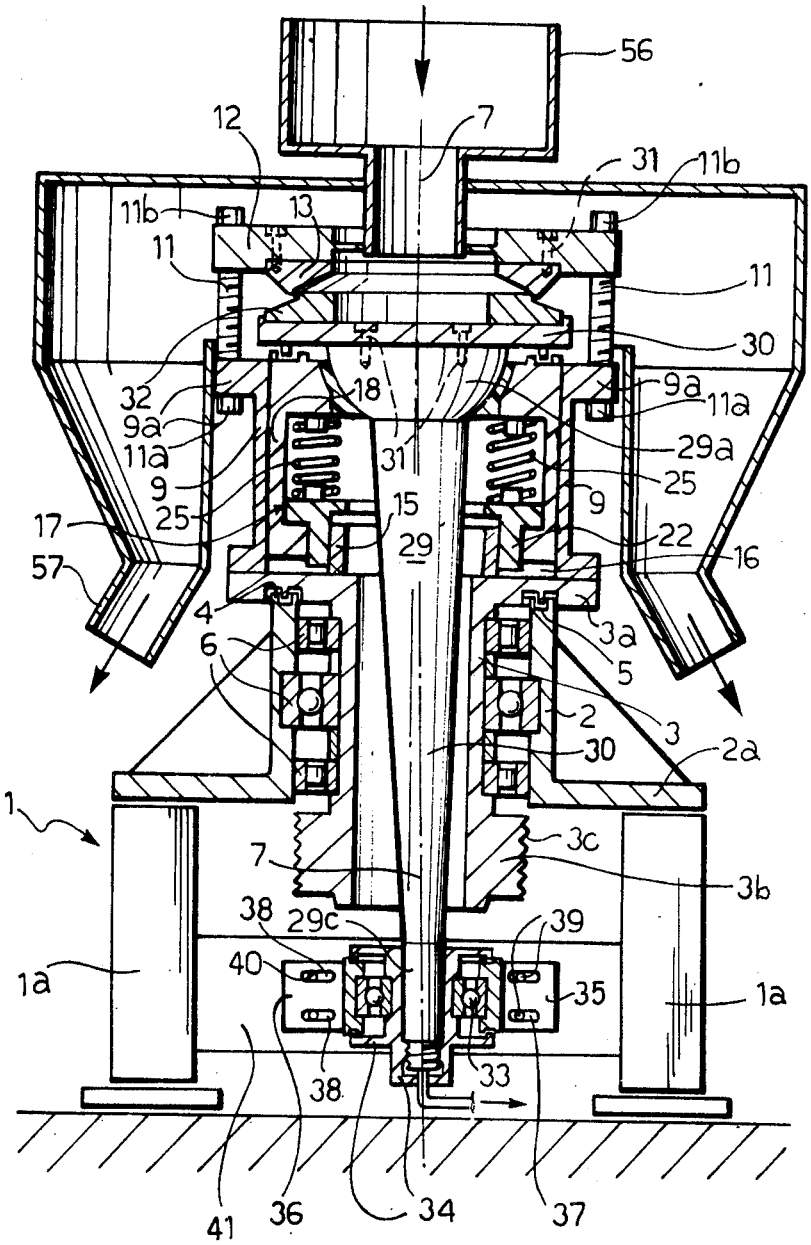

7
30
29b
31
27
45
44
29a
43b
54
50
49
28
27a
26
26a
29
18
9
51
46
25
17
23a
23b
52
43a
55
21
18a
20a
19
23
41
47
22
15
53
24a
30a
24
20
16
14
10
19a
7
3a
29c
5
2
6
3
43a
34
34a
42
48

PLATE MILL FOR PEBBLES, GRAVEL OR LIKE MATERIALS

This invention concerns a plate mill for pebbles, gravel or like materials, comprising a first crusher plate carried by a support structure and driven to rotate about an axis of rotation perpendicular to the plane of the plate, a second crusher plate facing the first plate and secured to an end of a shaft supported by the structure and freely rotatable about its longitudinal axis, and displaceable to change its angle of inclination in relation to the axis of rotation of the first plate.

In order to effect crushing or milling of pebbles, gravel or like materials in a mill of this general type, annular crusher plates are used which are supported so that their appropriate milling surfaces are facing each other; the plates are inclined to one another at a predetermined angle. The gravel to be milled is fed in between the two plates which, due to the rotation of the drive plate, carry the gravel between the two plates towards a region where the milling surfaces of the plates are closer together. The gravel thus undergoes simultaneous grinding and milling as the plates rotate.

In a plate mill of this type it is necessary to be able to adjust the distance between the grinding plates, and their relative inclination, in dependence on the size of the material to be milled and the particle size required when the material has been milled.

In known such mills, the mechanism for adjusting the distance between the grinding plates includes an adjustable bearing supporting the shaft on which the driven plate is mounted, this bearing can be adjusted, for example by means of screw thread devices, parallel to the axis of rotation of the driving plate. This mechanism has the disadvantage, however, that the adjustment must be carried out with the mill stationary, and must thus be repeated several times in order to obtain the required separation between the grinding plates.

For adjusting the relative inclination of the grinding plates, the end of the shaft to which the driven plate is affixed is mounted in a bearing which, in addition to being able to move along the axis of rotation of the driving plate also has to permit angular adjustment of the shaft. This bearing may also serve as the bearing, referred to above, for adjusting the distance between the plates. In another known type of plate mill, to achieve the desired relative inclination between the plates, there is provided an attachment between the shaft to which the driven plate is affixed and the bearing structure, connected by universal joints, flexible couplings, or the like. A common disadvantage of all these known constructions, however, is that the required relative inclination between the grinding plates has to be set when the mill is stationary.

Moreover, the necessary lubricating between the relatively moving parts of the whole structure of the plate mill also has to be effected with the mill stationary.

Another disadvantage of known constructions of plate mills is that if a non-crushable body is inadvertently present in the material for milling, then as it passes between the crushing plates it causes either distortion of one or both of the plates, or breakage of one, or sometimes both of the plates, with consequent loss of operating time while one or both of the grinding plates are replaced or repaired.

The present invention seeks, therefore to provide a plate mill in which the above mentioned disadvantages of known plate mills are overcome.

According to the present invention there is provided a plate mill for gravel or like materials, comprising a first crusher plate mounted on a support structure for rotation about an axis perpendicular to the plate, a second crusher plate carried facing the first plate and secured to one end of a shaft carried by the support structure so as to be rotatable about its longitudinal axis and angularly adjustable in relation to the axis of rotation of the first plate, and means for driving one of the two plates, in which there is a cylinder carried by the support structure so as to be coaxial with the first plate and surrounding a portion of the shaft at the upper end, an inner sleeve defining at one end of the cylinder an annular chamber coaxial with the cylinder, the annular chamber being closed at the end remote from the second plate, a piston assembly with an annular cross-section rotatably and axially slidable within the cylinder and extending into the annular chamber, the piston assembly including a member having a part-spherical socket in the end thereof nearest the second plate, the socket having a central opening therein larger than the diameter of the shaft, through which opening the shaft extends, an enlarged, part-spherical head of the shaft being engaged in the socket, the part-spherical head having an annular groove extending around it coaxially with respect to the axis of the shaft, a first conduit for lubricant formed in the annular piston, communicating at one end with the annular chamber and at the other end with the annular groove in the part-spherical head of the shaft, a second conduit for lubricant formed in the shaft, communicating at one end with the annular groove in the part-spherical head of the shaft and at the other end with a reservoir of lubricant, and means for pressurising the lubricant in the reservoir whereby to urge the piston assembly, carrying the second plate towards the first plate whereby to position the two plates a selected distance apart.

Reduction of the distance between the crusher plates of a mill made according to the present invention is thus effected by increasing the pressure of the lubricant, which then flows into the annular chamber in which the piston moves; increase of the plate separation is correspondingly achieved by reducing the lubricant pressure. In fact, when extra lubricant is forced into the annular chamber the pressure exerted on the piston causes this to be displaced axially along the annular chamber causing the second crusher plate to approach the first crusher plate. On the other hand, when lubricant is removed from the annular chamber, the pressure exerted on the piston reduces so that the second crusher plate can move away from the first crusher plate.

The main advantage of a mill constructed according to the invention lies in the fact that the desired pressure variations in the lubricant in order to effect adjustment to the spacing of the crusher plates can be effected whilst the mill is operating, by increasing or decreasing the pressure of the lubricant causing it to flow into or out from the annular chamber through the conduit passing axially down the shaft to which the second crusher plate is affixed. Consequently it is possible quickly and positively to adjust the distance between the crusher plates and hence to adjust the particle size of the product milled at any instant during milling so that the mill can be adjusted quickly by reference to the particle size of the milled material coming from the mill.

Another advantage of embodiments of the invention lies in the fact that when the mill is in operation, the pressure exerted upon the plates crushing the material between the plates is transferred into a pressure in the axial direction on the piston and thereby pressurises the lubricant in the annular chamber. Consequently, this lubricant is maintained under pressure in the annular groove in the part-spherical head of the shaft which supports the second crusher plate, and therefore proper lubrication between the part spherical head of the shaft and the part-spherical socket into which it is engaged is ensured.

A further advantage lies in the fact that embodiments of the present invention can be so constructed that at least one part of the piston assembly is axially and resiliently displaceable with respect to the remainder when the pressure of lubricant in the annular chamber exceeds a predetermined value so that if, as sometimes happens, one or more particles of non-crushable material should get between the crusher plates, then the sudden excessive forces exerted axially upon the plates is absorbed by the resiliently displaceable part of the piston which, in this case, acts as a shock absorber, thereby substantially reducing, if not entirely eliminating, the possibility of damage or breakage of the crusher plates during use.

Figure 2:
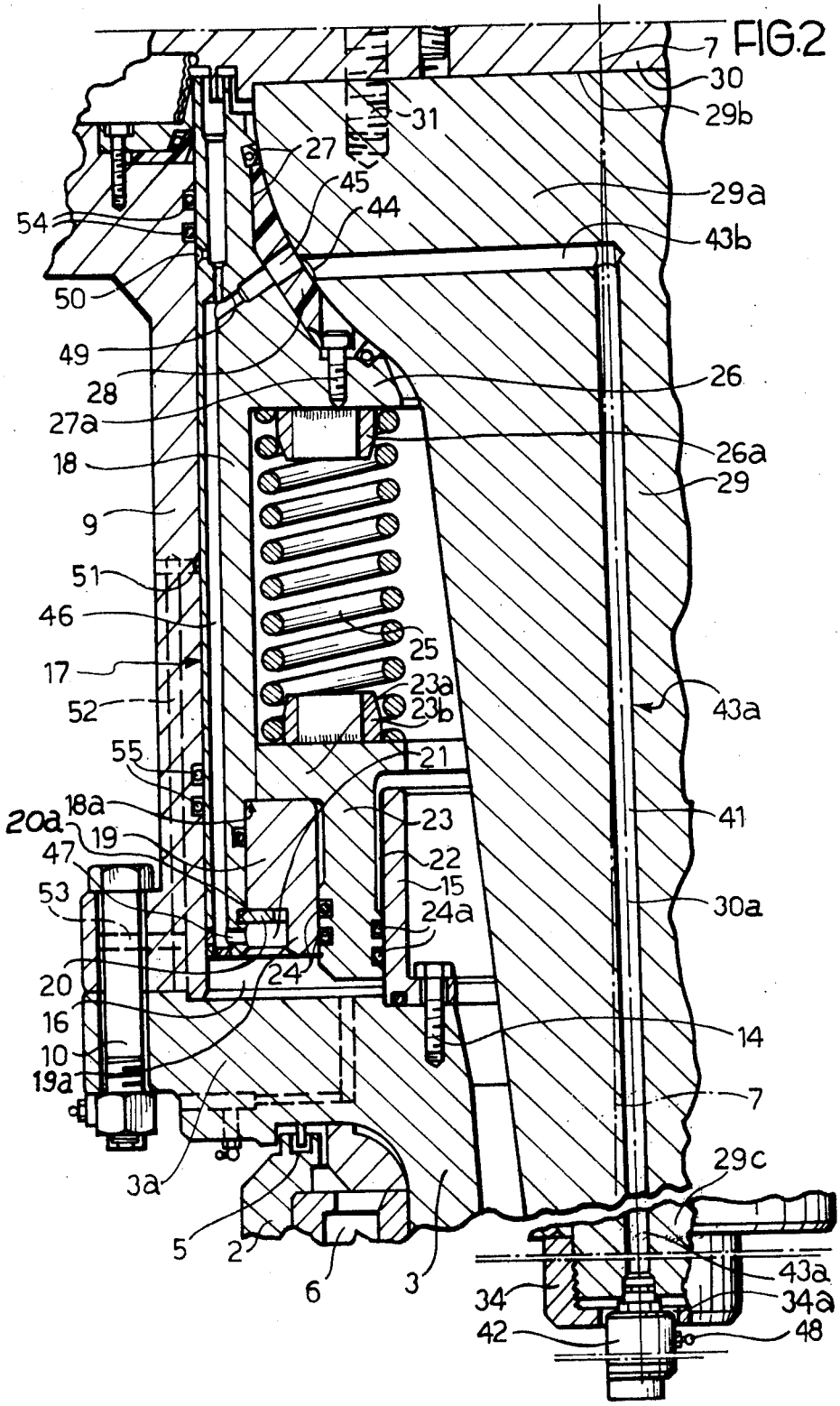

One embodiment of the present invention will now be more particularly described, by way of example, with reference to the accompanying drawings, in which:

FIG. 1 is an axial section of a vertical axis plate mill made as an embodiment of the invention; and FIG. 2 is a sectional view, on an enlarged scale, of a detail of FIG. 1.

Referring now to the drawings, there is shown a support structure, generally indicated 1, consisting of a number of uprights 1*a* and a cylindrical tubular body 2 positioned with its axis vertical; the tubular body 2 has a radial flange 2*a* at its lower end, by which it is fixed, by known means (not shown), on to the uprights 1*a*.

Mounted within the tubular body 2 is a cylinder 3 having an upper fixed annular flange 3*a*, in the lower face of which there are two circular grooves 4 coaxial with the cylinder 3. The upper end of the tubular body has a single circular groove 5 separated by two concentric circular ridges which fit into the circular grooves in the lower face of the upper flange of the cylinder 3. This engagement ensures that the cylinder 3 remains centralised within the tubular body 2. Interposed between the cylinder 3 and the inner wall of the tubular body 2 are three rolling element bearings 6. The vertical common axis of the cylinder 3 and the tubular body 2 is indicated by the broken line 7. A part 3*b* of the cylinder 3 projects below the flange 2*a* of the tubular body 2; this part 3*b* is formed as a pulley 3*c* around which passes a belt (not shown) driven by an electric motor, (also not shown).

A second cylinder 9 is fixed coaxially onto the upper flange 3*a* of the cylinder 3 by means of a number of bolts 10. The cylinder 9 has an upper annular radial flange 9*a* which supports an annular plate 12, which is coaxial with the cylinder 9, by means of a number of vertical spacers 11. The spacers 11 are formed by screws locked by nuts 11*a* to the flange 9*a* and by nuts 11*b* to the annular plate 12. By means of the screws 11 it is possible to adjust the plate 12 vertically up or down.

Affixed to this plate 12, below, and coaxially, is a first or upper annular crusher plate 13.

Within the cylinder 9, and coaxial with it, there is a cylindrical sleeve 15 secured to the flange 3*a* by screws 14 (FIG. 2). The height of the sleeve 15 is less than that of the cylinder 9. The sleeve 15 defines, with the inner wall of the cylinder 9, an annular chamber 16 which is closed at the bottom by the flange 3*a*, and is open above. The chamber 16 is intended to contain a pressure lubricant, as will be described in greater detail below.

Within the cylinder 9 there is a piston assembly, generally indicated 17, which is free to slide axially or turn about its axis. The piston 17 has an annular cross-section and has a lower portion, in the said annular chamber 16, which is axially movable with respect to the main portion.

With reference now to FIG. 2, the piston 17 has a cylindrical body 18, the axial length of which is less than that of the cylinder 9; the cylindrical body 18 can rotate and move freely axially in contact with the cylinder 9. Near to the lower end of the cylindrical body 18 there is mounted, internally and coaxially, a sleeve 19 which abuts an annular shoulder 18*a* formed on the inner wall of the cylinder 18, and is held in place by a conventional circular clip 20 fitted circumferentially into an annular groove 20*a* in the inner wall of the cylinder 18. An axially projecting collar portion 19*a* of the said sleeve 19 extends below the circular clip 20 and forms, with the inner wall of the cylinder 18, an annular chamber 21 open downwards and communicating with the lower annular chamber 16.

Between the inner wall of the sleeve 19 and the sleeve 15 there is an annular space 22 which houses a short cylindrical body 23 which is axially movable and free to rotate about the main axis 7 of the mill. Sealing rings 24, 24*a* form a seal between the short cylindrical body 23 and the sleeve 19, and between the cylindrical body 23 and the collar 15. The cylindrical body 23 has an upper radial flange 23*a*, maintained in contact with the sleeve 19 by a downward pressure exerted by a number of springs 25 compressed between the flange 23*a* and an inwardly directed annular projection 26 of the cylinder 18. The springs are located over and guided by spring-guide projections 23*b*, 26*a* on the annular flange 23*a* and the said inwardly directed annular projection 26 respectively. The overall axial length of the cylindrical body 23 is such that under normal operating conditions, as shown in FIG. 2, the lower end of the cylindrical body 23 is not in contact with the bottom of the annular chamber 16.

The piston assembly 17 thus consists of the outer cylindrical body 18, the sleeve 19 and the inner cylindrical body 23. The cylindrical body 23, in fact constitutes the part yielding resiliently against the action of a number of springs 25.

In the upper end of the cylindrical body 18, there is an upwardly concave socket formed in part by the upper face of the inwardly directed annular projection 26. Secured to the said socket 27, by means of screws 27*a*, is a bushing 28 of anti-friction material, the inner wall of which is formed as a part-spherical surface. This surface of the bushing 28 engages a hemispherical head 29*a* on the end of a shaft 29. The shaft 29 extends through the piston 17, the sleeve 15 and the cylinder 3, and the diameter of the shaft 29 is such that the shaft may be displaced angularly in relation to the axis 7 turning about a pivot formed by the hemispherical head 29a in the hemispherical socket formed by the bushing 28 which is fixedly secured in the upper end of the outer cylindrical body 18. The broken line 30a indicates the axis of the said shaft 29. The hemispherical head 29a has a flat upper wall 29b on which is fixed a circular plate 30, by means of screws 31. A second annular crusher plate 32 is secured to the plate 30 (FIG. 1) with its milling surface facing the milling surface of the upper crusher plate 13.

The lower end portion 29c (FIG. 1) of the shaft 29, which projects down outside the cylinder 3, is housed in a pivotable bearing 33 enclosed in a casing 34 which has opposite mounting plates 35, 36 in each of which there are elongate horizontal slots 37, 38. Through these slots 37, 38 pass bolts 39, 40 which are screwed into a horizontal crosspiece 41 spanning the uprights 1a of the support structure 1. The position of the pivoted bearing 33 can be adjusted in the horizontal direction by known means (not shown) over a range determined by the length of the slots 37, 38, and this movement adjusts the shaft 29 angularly in relation to the axis 7.

The shaft 29 has an axial bore 43a which communicates, through an opening 34a in the casing 34 of the bearing 33, with a lubricant tank 42 (FIG. 2), communicating in its turn by known means (not shown) with a device (also not shown) for feeding or discharging lubricant to or from the tank. The bore 43a communicates with a radial passageway 43b in the hemispherical head 29a, which passageway opens into an annular groove 44 running coaxially around the part-spherical wall of the said head 29a.

The annular groove 44 communicates by means of a transfer port 45 passing through the bushing 28 with a lubricant conduit 46 extending axially along the cylindrical body 18 of the piston assembly 17. This conduit 46 communicates, below, with the annular chamber 21 through a radial port 47 in the wall of the cylindrical body 18.

In operation of the mill, the lower annular chamber 16, the chamber 21, the conduit 46, the annular groove 44, the passageway 43b, the axial bore 43a and the tank 42 are completely filled with lubricant. Communication between the tank 42 and the feed device for the pressure lubricant may be cut off by known means shown diagrammatically and indicated by the reference numeral 48.

A conduit 49 in the cylindrical body 18 puts the conduit 46 in communication with a groove 50, extending coaxially around the outer wall of the cylindrical body 18. Another annular groove 51 extends coaxially around the inner wall of the cylinder 9 midway along its length and this groove 51 can be fed with lubricant from outside the cylinder 9 through conduits 52, 53 made in the wall of the cylinder 9. The annular grooves 50, 51 ensure lubrication between the walls in contact with one another of the cylindrical body 18 and the cylinder 9. Annular seals 54, 55 are provided in order to prevent the lubricant leaking out between the walls of the cylinder 9 and the cylindrical body 18.

In FIG. 1 there is shown a loading hopper 56 for material to be ground by the crusher plates 13, 32, and a conveyor fitting 57 for discharging the ground material out of the mill.

Adjustment of the separation between the crusher plates 13, 32 is effected by forcing pressure lubricant into, or allowing it to discharge from the annular chamber 16 through the conduits 43a, 43b in the shaft 29, the hole 45 in the bushing 28 and the conduit 46 in the cylindrical body 18 of the piston assembly 17. When the desired separation of the plates has been obtained, the required relative inclination thereof can be obtained by adjusting the position of the mounting plates 35, 36 of the casing 34 of the pivoted bearing 33. This effectively adjusts the relative inclination of the shaft 29 in relation to the axis 7 of the driving plate 13, thus also obtaining the desired relative inclination of the crusher plates 13, 32.

The mill can then be started and the material to be crushed fed in through the hopper 56 which feeds it in between the crusher plates 13, 32. The presence of the material between these crusher plates creates a stress which is exerted transverse the plates, that is axially of the shaft 29. This stress causes the plate 32 to be spaced further away from the plate 13. In order to bring this spacing to the desired value it is only necessary to feed more lubricant into the lower chamber 16. Following this, communication between the tank 42 and the lubricant feed device is cut off.

During grinding of the gravel the piston exerts a continual pressure upon the lubricant contained in the annular chamber 16, forcing this lubricant through the conduit 46 and the hole 45 into the groove 44 from where it supplies pressure lubrication between the part-spherical head 29a and the part-spherical seating 28. Moreover, the lubricant also travels from the conduit 46 to the conduit 49 and from each of these into the annular groove 50 where it supplies pressure lubrication between the contacting walls of the cylinder 9 and the cylindrical body 18 of the piston assembly 17.

During grinding it is possible to vary both the distance between the crusher plates 13, 32, and their relative inclination, without stopping the mill. If a non-crushable particle finds its way into the mill a sudden and considerable force is applied to the crusher plates 13, 32 and this is converted into a sudden plunge of the piston assembly 17 into the annular chamber 16. Consequently there is sudden increase of pressure of the lubricant in the chamber 16. When this increase of pressure exceeds the total thrust exerted by the springs 25 on the cylindrical body 23, this latter moves axially upwards. The excessive stress due to the presence of a non-crushable body between the plates is thus absorbed by the springs 25. The cylindrical body 23 and the springs 25 thus constitute a shock absorber. As soon as the non-crushable material is expelled outside the crusher plates, the springs 25 return the cylindrical body 23 back to its initial position in contact with the ring 19, re-establishing the initial conditions.

We claim:

1. In a plate mill for gravel or like materials, of the type comprising:

a support structure, a first crusher plate mounted on said support structure for rotation about an axis perpendicular to said plate, a second crusher plate carried on said support structure facing said first plate, a shaft carried by said support structure so as to be rotatable about its longitudinal axis and angularly adjustable in relation to the axis of rotation of said first plate, said shaft carrying said second plate at one end thereof for rotation about the axis of said shaft perpendicular to said plate, and means for driving one of said two plates to rotate, the improvement wherein there is provided:

a cylinder carried by said support structure coaxial with said first plate and surrounding a portion of said shaft at the upper end thereof, an inner sleeve fixed to said support structure at one end of said cylinder, said inner sleeve defining, with said cylinder, an annular chamber coaxial with said cylinder, said annular chamber being closed by said support structure at the end remote from said second plate, a piston assembly with an annular cross-section rotatably and axially slidable within said cylinder and extending into said annular chamber, a first member of said piston assembly having means defining a part-spherical socket in the end thereof nearest said second plate, said part-spherical socket having means defining a central opening therein larger than the diameter of said shaft, said shaft extending through said opening, an enlarged, part-spherical head on the end of said shaft, said part-spherical head being engaged in said part-spherical socket, means defining an annular groove extending around said part-spherical head coaxially with respect to the axis of said shaft, means defining a first lubricant conduit in said annular piston said first lubricant conduit communicating at one end thereof with said annular chamber, and at the other end thereof with said annular groove in said part-spherical head of said shaft, a lubricant reservoir, means defining a second lubricant conduit in said shaft, said second lubricant conduit communicating at one end thereof with said annular groove in said part-spherical head of said shaft, and at the other end with said lubricant reservoir, and means for pressurising said lubricant in said reservoir whereby to urge said piston assembly, carrying said second plate, towards said first plate whereby to position said two plates a selected distance apart.

2. The plate mill of claim 1, wherein at least one part of the said piston assembly is axially and resiliently displaceable with respect to the other parts when the pressure of lubricant in said annular chamber exceeds a predetermined value.

3. The plate mill of claim 1, wherein said part-spherical head of said shaft is generally hemispherical and has a flat face perpendicular to the axis of said shaft and facing away therefrom, said second crusher plate being attached to said flat face of said hemispherical head.

4. The plate mill of claim 1, wherein said piston assembly comprises an outer cylindrical body slidable axially and rotatably within said cylinder in contact with the inner wall thereof, said outer cylindrical body having an axial length which is less than the axial length of said cylinder, a fixed radially inwardly directed flange on said outer cylindrical body, a sleeve secured coaxially within said outer cylindrical body adjacent one end thereof, which end extends into said annular chamber, an inner cylindrical body slidable axially with its outer face in contact with the inner wall of said sleeve and its inner face in contact with said fixed inner sleeve forming one wall of said annular chamber, an outwardly directed radial flange on said inner cylindrical body, and a plurality of springs compressed between said inner cylindrical body and said fixed inwardly directed radial flange of said outer cylindrical body urging said inner cylindrical body axially to an end position where said outwardly directed radial flange thereof abuts said sleeve on said outer cylindrical body.

5. The plate mill of claim 1, wherein said cylinder is mounted on said support structure for rotation about its longitudinal axis, said first crusher plate is carried by said cylinder and attached thereto by means of a plurality of spacers, and said means for driving one of said crusher plates to rotate, acts to drive said cylinder to rotate about its longitudinal axis.

6. The plate mill of claim 1, wherein said longitudinal axis common to said cylinder and to said first plate is a substantially vertical axis.

* * * * *